US009938649B2

(12) United States Patent
Taninaka et al.

(10) Patent No.: US 9,938,649 B2
(45) Date of Patent: Apr. 10, 2018

(54) FIBROUS NETWORK STRUCTURE HAVING EXCELLENT COMPRESSION DURABILITY

(71) Applicant: TOYOBO CO., LTD., Osaka-shi, Osaka (JP)

(72) Inventors: Teruyuki Taninaka, Otsu (JP); Shinichi Kobuchi, Osaka (JP); Hiroyuki Wakui, Otsu (JP)

(73) Assignee: TOYOBO CO., LTD., Osaka-shi (JP)

( * ) Notice: Subject to any disclaimer, the term of this patent is extended or adjusted under 35 U.S.C. 154(b) by 0 days.

(21) Appl. No.: 15/032,924

(22) PCT Filed: Oct. 28, 2014

(86) PCT No.: PCT/JP2014/078562

§ 371 (c)(1),
(2) Date: Apr. 28, 2016

(87) PCT Pub. No.: WO2015/064557

PCT Pub. Date: May 7, 2015

(65) Prior Publication Data

US 2016/0251789 A1 Sep. 1, 2016

(30) Foreign Application Priority Data

| | | |
|---|---|---|
| Oct. 29, 2013 | (JP) | 2013-224009 |
| Jan. 24, 2014 | (JP) | 2014-011072 |
| Feb. 13, 2014 | (JP) | 2014-025091 |
| Feb. 13, 2014 | (JP) | 2014-025092 |

(51) Int. Cl.

| | |
|---|---|
| ***D04H 3/16*** | (2006.01) |
| ***D04H 3/007*** | (2012.01) |
| ***D04H 3/011*** | (2012.01) |

(52) U.S. Cl.
CPC ..... *D04H 3/16* (2013.01); *D04H 3/007* (2013.01); *D04H 3/011* (2013.01)

(58) Field of Classification Search
CPC ..... B29C 47/0019; B29C 47/0014; B29C 47/0021; B29C 47/003; B29C 47/888; B29C 47/8895; B29C 43/02; B29C 43/22; B29C 47/0033; B29C 47/084; B29C 47/12; B29C 47/126; B29C 47/30; B29B 13/04; D04H 3/03; D04H 3/037; D04H 3/16; D04H 3/153; D04H 3/14; D01D 5/0885; D01D 5/23
See application file for complete search history.

(56) References Cited

U.S. PATENT DOCUMENTS

| | | | | |
|---|---|---|---|---|
| 3,852,152 | A * | 12/1974 | Werner | D04H 3/16 156/167 |
| 5,312,893 | A | 5/1994 | Hamano et al. | |
| 5,352,534 | A | 10/1994 | Hamano et al. | |
| 5,639,543 | A * | 6/1997 | Isoda | D04H 3/03 114/363 |
| 2002/0041949 | A1 | 4/2002 | Nishibori et al. | |
| 2007/0001336 | A1 * | 1/2007 | Nishibori | A47C 27/12 264/103 |
| 2013/0189472 | A1 * | 7/2013 | Takaoka | D01D 10/00 428/85 |
| 2016/0010250 | A1 | 1/2016 | Taninaka et al. | |
| 2016/0347603 | A1 | 12/2016 | Zammit et al. | |

FOREIGN PATENT DOCUMENTS

| | | | |
|---|---|---|---|
| EP | 2 966 206 | A1 | 1/2016 |
| JP | 6-25441 | A | 2/1994 |
| JP | 7-68061 | A | 3/1995 |
| JP | 7-189105 | A | 7/1995 |
| JP | 7-327436 | A | 12/1995 |
| JP | 2002-61059 | A | 2/2002 |
| JP | 2002-266223 | A | 9/2002 |
| JP | 2004-244740 | A | 9/2004 |
| JP | 5454733 | B1 | 3/2014 |
| JP | 5454734 | B1 | 3/2014 |
| WO | 2014/132484 | A1 | 9/2014 |

OTHER PUBLICATIONS

International Search Report dated Jan. 13, 2015, issued in counterpart International Application No. PCT/JP2014/078562 (2 pages).
Extended (supplementary) European Search Report dated Jun. 19, 2017, issued in counterpart European Application No. 14858976.5. (6 pages).

* cited by examiner

*Primary Examiner* — Maria V Ewald
*Assistant Examiner* — Zachary M Davis
(74) *Attorney, Agent, or Firm* — Westerman, Hattori, Daniels & Adrian, LLP

(57) ABSTRACT

A network structure is disclosed including a three-dimensional random loop bonded structure obtained by forming random loops with curling treatment of a continuous linear structure including at least one thermoplastic elastomer selected from a polyester-based thermoplastic elastomer, a polyolefin-based thermoplastic elastomer, and an ethylene-vinyl acetate copolymer, and by making each loop mutually contact in a molten state, wherein a fiber diameter of the continuous linear structure is not less than 0.1 mm and not more than 3.0 mm, a fiber diameter of a surface layer portion of the network structure is not less than 1.05 times of a fiber diameter of an inner layer portion thereof, an apparent density is not less than 0.01 g/cm$^3$ and not more than 0.20 g/cm$^3$, 750 N-constant load repeated compression residual strain is not more than 15%, and 40%-compression hardness retention after 750 N-constant load repeated compression is not less than 55%.

7 Claims, No Drawings

FIBROUS NETWORK STRUCTURE HAVING EXCELLENT COMPRESSION DURABILITY

TECHNICAL FIELD

The present invention relates to a network structure suitable for cushioning materials that are used for office chairs, furniture, sofas, beddings such as beds, and seats for vehicles such as those for trains, automobiles, two-wheeled vehicles, child seats and buggies, and floor mats and mats for impact absorption such as members for prevention of collision and nipping, etc., the network structure having excellent repeated compression durability.

BACKGROUND ART

At present, foamed-crosslinking type urethanes are widely used a cushioning material that is used for furniture, beddings such as beds, and seats for vehicles such as those for trains, automobiles and two-wheeled vehicles.

Although foamed-crosslinking type urethanes have excellent durability as a cushioning material, they have inferior moisture and water permeability and air permeability, and have thermal storage property to exhibit possible humid feeling. Since the foamed-crosslinking type urethanes do not have thermoplasticity, they have difficulty in recycling, and therefore they give significant damage to incinerators in case of incineration, and need high costs in elimination of poisonous gas. For this reason, the foamed-crosslinking type urethanes are often disposed of by landfill, but limitation of landfill spots based on difficulty of stabilization of ground causes problems of the necessity for higher costs. Furthermore, although the foamed-crosslinking type urethanes have excellent workability, they may cause various problems such as pollution problems with chemicals that have been used in the manufacturing process, residual chemicals after foaming and associated offensive odors.

Patent Documents 1 and 2 disclose network structures. They are capable of solving various problems associated with the foamed-crosslinking type urethanes and have excellent cushioning performance. As for repeated compression durability properties, however, only the 50%-constant displacement repeated compression residual strain is excellent. The 50%-compression hardness retention after 50% repeated compression is about 83%, thus a hardness is low after repeated use.

Conventionally, if the repeated compression residual strain is low, durability performance is considered to be sufficient. However, in recent years, requirements for repeated compression durability have become higher. Thus, a 40%-compression hardness retention after 750 N-constant load repeated compression equivalent to a human body weight of about 76 kgs is emphasized instead of an evaluation of 50%-constant displacement repeated compression durability, and requirements for improving the constant load repeated compression durability have become higher. In a conventional network structure, a 40%-compression hardness retention after 750 N-constant load repeated compression is only about 50%, and the improvement thereof is desired. However, it is difficult to obtain, from a conventionally known network structure, a network structure having a high hardness retention after constant load repeated compression.

Patent Document 3 discloses a network structure that includes fibers which are different in fineness and a method for manufacturing the same. In this structure and the method, for the surface layer and the base layer, a ratio in sectional secondary moment of a circular cross-sectional area is used to define a difference in fineness, and a soft layer having a small fiber diameter is provided in the surface and an inner layer in which a fiber diameter is large so as to have durability is provided as the base layer, thereby improving cushioning performance and durability. This manufacturing method is excellent conventionally for a 50%-constant displacement repeated compression. However, the manufacturing method, the structure, or the like are not necessarily excellent for a 750 N constant load repeated compression durability that is tested more strictly and is to be achieved by the present invention, and it is difficult to achieve the scope of the present invention thereby.

PRIOR ART DOCUMENT

Patent Documents

Patent Document 1: Japanese Patent Publication No. H07-68061

Patent Document 2: Japanese Patent Publication No. 2004-244740

Patent Document 3: Japanese Patent Publication No. H07-189105

SUMMARY OF THE INVENTION

Problems to be Solved by the Invention

An object of the present invention is to solve the problems of the conventional technology, and to provide a network structure in which a 750 N-constant load repeated compression residual strain is not more than 15%, and a 40% hardness retention after 750 N-constant load repeated compression is not less than 55%, and which is thus excellent in repeated compression properties.

Solutions to the Problems

A network structure which is excellent in hardness retention, thickness retention, and repeated compression durability, has been achieved as a result of wholehearted investigation performed by the present inventors in order to solve the above-described problems.

That is, the present invention includes:

(1) A network structure comprising a three-dimensional random loop bonded structure obtained by forming random loops with curling treatment of a continuous linear structure including at least one thermoplastic elastomer selected from the group consisting of a polyester-based thermoplastic elastomer, a polyolefin-based thermoplastic elastomer, and an ethylene-vinyl acetate copolymer, and by making each loop mutually contact in a molten state, wherein a fiber diameter of the continuous linear structure is not less than 0.1 mm and not more than 3.0 mm, a fiber diameter of a surface layer portion of the network structure is not less than 1.05 times of a fiber diameter of an inner layer portion thereof, an apparent density is not less than 0.01 g/cm$^3$ and not more than 0.20 g/cm$^3$, 750 N-constant load repeated compression residual strain is not more than 15%, and 40%-compression hardness retention after 750 N-constant load repeated compression is not less than 55%.

(2) The network structure according to (1), wherein 65% t-compression hardness retention after 750 N-constant load repeated compression is not less than 70%.

(3) The network structure according to (1) or (2), wherein a compression-deflection coefficient is not less than 2.5.

(4) The network structure according to any one of (1) to (3), wherein the network structure has a thickness of not less than 10 mm and not more than 300 mm.

(5) The network structure according to any one of (1) to (4), wherein 40%-compression hardness retention after 750 N-constant load repeated compression is not less than 60%.

(6) The network structure according to any one of (1) to (5), wherein 40%-compression hardness retention after 750 N-constant load repeated compression is not less than 659%.

(7) The network structure according to any one of (1) to (6), wherein 65%-compression hardness retention after 750 N-constant load repeated compression is not less than 73%.

Effects of the Invention

The network structure according to the present invention can be provided which has a low constant load repeated compression residual strain, is excellent in hardness retention, hardly causes a change in sitting comfort even after repeated use, and is excellent in repeated compression durability. The excellent repeated compression durability allows cushions of the network structure which are excellent in repeated compression durability and are used for office chairs, furniture, sofas, beddings such as beds, and seats for vehicles such as those for trains and automobiles, to be provided.

MODE FOR CARRYING OUT THE INVENTION

Hereinafter, the present invention will be described in detail.

A network structure of the present invention is a network structure made of a three-dimensional random loop bonded structure obtained by forming random loops with curling treatment of a continuous linear structure including at least one thermoplastic elastomer selected from the group consisting of a polyester-based thermoplastic elastomer, a polyolefin-based thermoplastic elastomer, and an ethylene-vinyl acetate copolymer, and by making each loop mutually contact in a molten state. In the network structure, a fiber diameter of the continuous linear structure is not less than 0.1 mm and not more than 3.0 mm, a fiber diameter of a surface layer portion of the network structure is not less than 1.05 times of a fiber diameter of an inner layer portion thereof, an apparent density is not less than 0.01 g/cm$^3$ and not more than 0.20 g/cm$^3$, a 750 N-constant load repeated compression residual strain is not more than 15%, and a 40%-compression hardness retention after 750 N-constant load repeated compression is not less than 55%.

As the polyester-based thermoplastic elastomer in the present invention, a polyester ether block copolymer having a thermoplastic polyester as a hard segment and a polyalkylenediol as a soft segment or a polyester ester block copolymer having an aliphatic polyester as a soft segment may be mentioned as examples.

The more specific examples of the polyester ether block copolymer include a triblock copolymer formed of at least one of dicarboxylic acids selected from aromatic dicarboxylic acids such as terephthalic acid, isophthalic acid, naphthalene-2,6-dicarboxylic acid, naphthalane-2,7-dicarboxylic acid and diphenyl-4,4'-dicarboxylic acid, cycloaliphatic dicarboxylic acids such as 1,4-cyclohexanedicarboxylic acid, aliphatic dicarboxylic acids such as succinic acid, adipic acid, sebacic acid and dimer acid and ester forming derivatives thereof; at least one of diol components selected from aliphatic diols such as 1,4-butanediol, ethylene glycol, trimethylene glycol, tetramethylene glycol, pentamethylene glycol and hexamethylene glycol and cycloaliphatic diols such as 1,1-cyclohexanedimethanol, 1,4-cyclohexanedimethanol and ester forming derivatives thereof; and at least one of polyalkylenediols such as glycols including polyethylene glycol, polypropylene glycol, polytetramethylene glycol or an ethylene oxide-propylene oxide copolymer, the number average molecular weight of which is about not less than 300 and not more than 5000.

The polyester ester block copolymer is a triblock copolymer formed of at least one of the above-described dicarboxylic acids, at least one of the above-described diols, and at least one of polyester diols such as polylactone, the number average molecular weight of which is about not less than 300 and not more than 5000. When considering heat adhesiveness, hydrolysis resistance, stretchability and heat resistance etc., triblock copolymers having terephthalic acid or naphthalene-2,6-dicarboxylic acid as a dicarboxylic acid, 1,4-butanediol as a diol component, and polytetramethylene glycol as a polyalkylenediol, or triblock copolymers having polylactone as a polyester diol are especially preferred. In special cases, those containing a polysiloxane-based soft segment may also be used.

Further, the polyester-based thermoplastic elastomer of the present invention also encompasses those obtained by blending or copolymerizing a non-elastomer component with the polyester-based thermoplastic elastomer and those having a polyolefin-based component as a soft segment. These polyester-based elastomers may be used singly or by mixing not less than two kinds thereof. An antioxidant, a light resisting agent, or the like may be added as appropriate for improving durability. It is also effective to increase the molecular weight of the thermoplastic resin for improving heat resistance and durability, or setting resistance.

The melting point of the polyester-based thermoplastic elastomer of the present invention is preferably not less than 140° C. for maintaining heat resistance and durability, and more preferably not less than 160° C. for improving heat resistance and durability.

For achieving repeated compression durability of a network structure, which is an object of the present invention, the content of a soft segment in the polyester-based thermoplastic elastomer is preferably not less than 15% by weight, more preferably not less than 25% by weight, still more preferably not less than 30% by weight, especially preferably not less than 40% by weight, and for securing the hardness and from the viewpoint of heat and setting resistance, the content of a soft segment in the polyester-based thermoplastic elastomer is preferably not more than 80% by weight, more preferably not more than 70% by weight.

Preferably, a component including the polyester-based thermoplastic elastomer, which forms the network structure having excellent repeated compression durability of the present invention, has an endothermic peak at a temperature of not higher than the melting point in a melting curve obtained by measurement using a differential scanning calorimeter. Those having an endothermic peak at a temperature of not higher than the melting point have significantly improved heat and setting resistance as compared to those having no endothermic peak. For example, in a case where the copolymer, which is produced by carrying out an transesterification of those comprising an acid component containing terephthalic acid or naphthalene-2,6-dicarboxylic acid etc. having stiffness in an amount of not less than 90% by mol, the content of terephthalic acid or naphthalene-2,6-dicarboxylic acid being more preferably not less than 95% by mol, especially preferably 100% by mol as a hard segment with a glycol component, thereafter polymerizing the resulting product to a necessary polymerization degree, and copolymerizing with the polyalkylene diol such as preferably not less than 15% by weight and not more than 80% by weight, more preferably not less than 25% by weight and not more than 70% by weight, still more preferably not less than 30% by weight and not more than 70% by weight, especially preferably not less than 40% by weight and not more than 70% by weight of the polytetramethylene glycol having an average molecular weight of preferably not less than 500 and not more than 5000, more preferably not less than 700 and not more than 3000, still more preferably not less than 800 and not more than 1800, is used as the preferred polyester-based thermoplastic elastomer of the present invention, crystallinity of hard segment is improved, plastic deformation is hard to occur and heat and setting resistance is improved when the acid component of hard segment has a high content of terephthalic acid or naphthalene-2,6-dicarboxylic acid having stiffness. When annealing treatment is further performed at a temperature lower by at least 10° C. than the melting point after hot-melt bonding, heat and setting resistance is further improved. It suffices that the sample can be heat-treated at a temperature lower by at least 10° C. than the melting point in annealing treatment, then a compressive strain is imparted and heat and setting resistance is further improved. An endothermic peak appears more clearly at a temperature of not lower than room temperature and not higher than the melting point in a melting curve obtained by measuring the cushioning layer treated as described above using a differential scanning calorimeter. When annealing is not performed, an endothermic peak does not appear clearly in the melting curve at a temperature of not lower than room temperature and not higher than the melting point. From this, it can be thought that by annealing, a hard segment is rearranged to form a semi-stable intermediate phase, so that heat and setting resistance is improved. As an approach for utilizing the heat resistance improving effect in the present invention, use in applications supposed to involve a relatively high temperature, such as cushions for vehicles using a heater and flooring mats for heated floors, is effective because setting resistance is improved in those applications.

The polyolefin-based thermoplastic elastomer of the present invention is preferably a low density polyethylene resin in which a polymer forming the network structure has a specific gravity of not more than 0.94 g/cm$^3$, and particularly preferably includes an ethylene-α-olefin copolymer resin that contains ethylene and an α-olefin having not less than three carbon atoms. The ethylene-α-olefin copolymer of the present invention is preferably a copolymer described in Japanese Patent Application Publication No. H6-293813, and is a copolymer that is obtained by copolymerizing ethylene with an α-olefin having not less than three carbon atoms. Examples of the α-olefin having not less than three carbon atoms include propylene, butene-1, pentene-1, hexene-1, 4-methyl-1-pentene, heptene-1, octene-1, nonene-1, decene-1, undecene-1, dodecene-1, tridecene-1, tetradecene-1, pentadecene-1, hexadecene-1, heptadecene-1, octadecene-1, nonadecene-1, and eicosene-1. The α-olefin having not less than three carbon atoms is preferably butene-1, pentene-1, hexene-1, 4-methyl-1-pentene, heptene-1, octene-1, nonene-1, decene-1, undecene-1, dodecene-1, tridecene-1, tetradecene-1, pentadecene-1, hexadecene-1, heptadecene-1, octadecene-1, nonadecene-1, or eicosene-1. Further, not less than two of them may be used. The α-olefin is generally copolymerized in an amount of 1 to 40% by weight. The copolymer can be obtained by ethylene and the α-olefin being copolymerized by using a catalyst system having a specific metallocene compound and an organic metallic compound as basic components.

Not less than two kinds of polymers obtained by polymerization being performed in the method described above, and/or a polymer such as hydrogenated polybutadiene or hydrogenated polyisoprene may be blended as appropriate. An antioxidant, a weather resistant agent, a flame retardant, or the like may be added as a modifier as appropriate.

When the specific gravity of the polyolefin-based thermoplastic elastomer of the present invention exceeds 0.94 g/cm$^3$, a cushioning material is likely to be disadvantageously hardened. The specific gravity thereof is more preferably not more than 0.935 g/cm$^3$, and still more preferably not more than 0.93 g/cm$^3$. The lower limit of the specific gravity thereof is not particularly defined, but the specific gravity thereof is preferably not less than 0.8 g/cm$^3$, and more preferably not less than 0.85 g/cm$^3$ in view of maintaining the strength.

Preferably, a component including the polyolefin-based thermoplastic elastomer, which forms the network structure having excellent repeated compression durability in the present invention, has an endothermic peak at a temperature of not higher than the melting point in a melting curve obtained by measurement using a differential scanning calorimeter. Those having an endothermic peak at a temperature of not higher than the melting point have significantly improved heat and setting resistance as compared to those having no endothermic peak. For example, in a case where, a preferable polyolefin-based thermoplastic elastomer of the present invention is an ethylene-α-olefin copolymer obtained by hexane, hexene, and ethylene being polymerized using a metallocene compound as a catalyst in a publicly known method, when the number of branches of a main chain is reduced, crystallinity of hard segment is improved and plastic deformation is hard to occur and heat and setting resistance is improved. When annealing treatment is further performed at a temperature lower by at least 10° C. than the melting point after hot-melt bonding, heat and setting resistance is further improved. It suffices that the sample can be heat-treated at a temperature lower by at least 10° C. than the melting point in annealing treatment, then a compressive strain is imparted and heat and setting resistance is further improved. An endothermic peak appears more clearly at a temperature of not lower than room temperature and not higher than the melting point in a melting curve obtained by measuring the cushioning layer treated as described above using a differential scanning calorimeter. When annealing is not performed, an endothermic peak does not appear clearly in the melting curve at a temperature of not lower than room temperature and not higher than the melting point. From this, it can be thought that by annealing, a hard segment is rearranged to form a semi-stable intermediate phase, so that heat and setting resistance is improved. As an approach for utilizing the setting resistance improving effect in the present invention, use in applications in which repeated compression relatively often occurs, such as cushions and flooring mats, is effective because durability is improved in those applications.

The ethylene-vinyl acetate copolymer of the present invention used as a polymer for forming the network structure, has a specific gravity of 0.91 to 0.965 preferably. The specific gravity changes depending on the content of vinyl acetate, and the content of vinyl acetate is preferably 1 to 35%. When the content of vinyl acetate is low, rubber elasticity may become insufficient. In this viewpoint, the content of vinyl acetate is preferably not less than 1%, more preferably not less than 2%, and still more preferably not less than 3%. When the content of vinyl acetate is high, the melting point is lowered and heat resistance may become insufficient while rubber elasticity is excellent. Therefore, the content of vinyl acetate is preferably not more than 35%, more preferably not more than 30%, and still more preferably not more than 26%.

The ethylene-vinyl acetate copolymer of the present invention may be copolymerized with an α-olefin having not less than three carbon atoms. Examples of the α-olefin having not less than three carbon atoms include propylene, butene-1, pentene-1, hexene-1, 4-methyl-1-pentene, heptene-1, octene-1, nonene-1, decene-1, undecene-1, dodecene-1, tridecene-1, tetradecene-1, pentadecene-1, hexadecene-1, heptadecene-1, octadecene-1, nonadecene-1, and eicosene-1. The α-olefin having not less than three carbon atoms is preferably butene-1, pentene-1, hexene-1, 4-methyl-1-pentene, heptene-1, octene-1, nonene-1, decene-1, undecene-1, dodecene-1, tridecene-1, tetradecene-1, pentadecene-1, hexadecene-1, heptadecene-1, octadecene-1, nonadecene-1, or eicosene-1. Further, not less than two of them may be used.

Not less than two kinds of polymers obtained by polymerization being performed in the method described above, and/or a polymer modifier such as hydrogenated polybutadiene or hydrogenated polyisoprene may be blended as appropriate. A lubricant, an antioxidant, a weather resistant agent, a flame retardant, or the like may be added as a modifier as appropriate.

Preferably, a component including the ethylene-vinyl acetate copolymer, which forms the network structure having excellent repeated compression durability in the present invention, has an endothermic peak at a temperature of not higher than the melting point in a melting curve obtained by measurement using a differential scanning calorimeter. Those having an endothermic peak at a temperature of not higher than the melting point have significantly improved heat and setting resistance as compared to those having no endothermic peak. For example, in the preferable ethylene-vinyl acetate copolymer of the present invention, the content ratio of vinyl acetate is preferably not more than 35%, more preferably not more than 30%, still more preferably not more than 26%. When the content ratio of vinyl acetate is reduced, crystallinity of hard segment is improved and plastic deformation is hard to occur and heat and setting resistance is improved. When annealing treatment is further performed at a temperature lower by at least 10° C. than the melting point after hot-melt bonding, heat and setting resistance is further improved. It suffices that the sample can be heat-treated at a temperature lower by at least 10° C. than the melting point in annealing treatment, then a compressive strain is imparted and heat and setting resistance is further improved. An endothermic peak appears more clearly at a temperature of not lower than room temperature and not higher than the melting point in a melting curve obtained by measuring the cushioning layer treated as described above using a differential scanning calorimeter. When annealing is not performed, an endothermic peak does not appear clearly in the melting curve at a temperature of not lower than room temperature and not higher than the melting point. From this, it can be thought that by annealing, a hard segment is rearranged to form a semi-stable intermediate phase, so that heat and setting resistance is improved. As an approach for utilizing the setting resistance improving effect in the present invention, use in applications in which repeated compression relatively often occurs, such as cushions and flooring mats, is effective because durability is improved in those applications. Further, it is also effective to increase the molecular weight of the vinyl acetate copolymer for improving setting resistance.

The fiber diameter of the continuous linear structure forming the network structure of the present invention should be set in a proper range because when the fiber diameter is small, a necessary hardness cannot be maintained when the network structure is used as a cushioning material, and conversely when the fiber diameter is excessively large, the hardness becomes excessively high. The fiber diameter is not less than 0.1 mm and not more than 3.0 mm, preferably not less than 0.2 mm and not more than 2.5 mm. When the fiber diameter is less than 0.1 mm, the network structure becomes so thin that although denseness and soft touch are improved, it may be difficult to secure a necessary hardness as a network structure. When the fiber diameter exceeds 3.0 mm, the hardness of the network structure can be sufficiently secured, but the network structure may become coarse, leading to deterioration of other cushioning performance.

In the network structure of the present invention, a fiber diameter of the surface layer portion is not less than 1.05 times of a fiber diameter of the inner layer portion, preferably not less than 1.08 times thereof, more preferably not less than 1.10 times thereof. When the fiber diameter of the surface layer portion is less than 1.05 times of the fiber diameter of the inner layer portion, necessary surface stiffness and strength of contact points in the surface layer cannot be assured, and hardness retention necessary for cushioning properties may not be stably obtained. The upper limit of the ratio of the fiber diameter of the surface layer portion to the fiber diameter of the inner layer portion is not particularly defined, but the ratio thereof is not more than 1.25 times in the present invention.

The apparent density of the network structure of the present invention is 0.01 g/cm$^3$ to 0.20 g/cm$^3$, preferably 0.02 g/cm$^3$ to 0.15 g/cm$^3$, more preferably 0.025 g/cm$^3$ to 0.12 g/cm$^3$. When the apparent density is less than 0.01 g/cm$^3$, a necessary hardness cannot be maintained when the network structure is used as a cushioning material, and conversely when the apparent density exceeds 0.20 g/cm$^3$, the hardness may become so high that the network structure is unsuitable for a cushioning material that provides soft touch.

The 750 N-constant load repeated compression residual strain of the network structure of the present invention is not more than 15%, preferably not more than 10%. When the 750 N-constant load repeated compression residual strain exceeds 15%, the network structure is reduced in thickness after a long period of use, and is not preferred as a cushioning material. The lower limit of the 750 N-constant load repeated compression residual strain is not particularly defined, but it is not less than 0.1% in the case of the network structure obtained in the present invention.

The 40%-compression hardness of the network structure of the present invention is preferably 40 N/φ200 to 1000 N/φ200. When the 40%-compression hardness is less than 40 N/φ200, a bottoming feeling may be given. When the 40%-compression hardness exceeds 1000 N/φ200, the hardness may be so high that cushioning performance is impaired.

The 40%-compression hardness retention after 750 N-constant load repeated compression of the network structure of the present invention is not less than 55%, preferably not less than 60%, more preferably not less than 65%, still more preferably not less than 70%. When the 40%-compression hardness retention after 750 N-constant load repeated compression is less than 55%, the hardness of the cushioning material is reduced after a long period of use, and significant change of the hardness may be felt. The upper limit of the 40%-hardness retention after 750 N-constant load repeated compression is not particularly defined, but it is not more than 95% in the case of the network structure obtained in the present invention.

The 65% compression hardness of the network structure of the present invention is preferably 80 N/φ200 to 2000 N/φ200. When the 65% compression hardness is less than 80 N/φ200, a bottoming feeling may be given. When the 65% compression hardness exceeds 2000 N/φ200, the hardness may be so high that cushioning performance is impaired.

The 65%-compression hardness retention after 750 N-constant load repeated compression of the network structure of the present invention is not less than 70%, preferably not less than 73%, more preferably not less than 75%, still more preferably not less than 80%. When the 65% hardness retention after 750 N-constant load repeated compression is less than 70%, the hardness of the cushioning material is reduced after a long period of use, and a bottoming feeling may be given. The upper limit of the 65%-compression hardness retention after 750 N-constant load repeated compression is not particularly defined, but it is not more than 99% in the case of the network structure obtained in the present invention.

The compression-deflection coefficient of the network structure of the present invention is preferably not less than 2.5, more preferably not less than 2.8, still more preferably not less than 3.0. When the compression-deflection coefficient is less than 2.5, sitting or sleeping comfort given as the cushioning material may be impaired. The upper limit of the compression-deflection coefficient is not particularly defined, but it is not more than 8.0 in the case of the network structure obtained in the present invention.

The thickness of the network structure of the present invention is preferably not less than 10 mm, more preferably not less than 20 mm. When the thickness is less than 10 mm, the network structure may be so thin that a bottoming feeling is given when the network structure is used as a cushioning material. The upper limit of the thickness is preferably not more than 300 mm, more preferably not more than 200 mm, still more preferably not more than 120 mm in view of manufacturing equipment.

The 25%-compression hardness of the network structure of the present invention is preferably 10 N/φ200 to 600 N/φ200. When the 25%-compression hardness is less than 10 N/φ200, a bottoming feeling may be given. When the 25%-compression hardness exceeds 600 N/φ200, the hardness may be so high that cushioning performance is impaired.

When the network structure of the present invention consisting of the polyester-based thermoplastic elastomer, the 70° C. compression residual strain is preferably not more than 35%. When the 70° C. compression residual strain exceeds 35%, property requirements as a network structure to be used for an intended cushioning material are not satisfied. The lower limit of the 70° C. compression residual strain is not particularly defined, but it is not less than 0.1% in the case of the network structure obtained in the present invention.

The network structure of the present invention preferably has such properties that the 40%-compression hardness retention after 750 N-constant load repeated compression is not less than 55%, and the 65%-compression hardness retention after 750 N-constant load repeated compression is not less than 70%. Only when the hardness retention is in the above-described range, a network structure is obtained which has a reduced change in hardness of the network structure after a long period of use and which can be used for a long period of time in a comfortable state with a small change in sitting or sleeping comfort. The 750 N-constant load repeated compression test is a test for evaluating durability higher than that tested in the 50%-constant displacement repeated compression test on which attention has been paid in prior art documents. The reason is as follows. In the 50%-constant displacement repeated compression test, an amount of compression is fixed to 50% of the thickness from the start of the process to the end of the process. However, in the 750 N-constant load repeated compression durability test, for example, even if the load of 750 N is equivalent to 50% displacement of the thickness at the start of the process, the hardness is reduced during the repeated compression process, so that the amount of compression exceeds 50% of the thickness at the end of the process. Therefore, an amount of deformation of the sample during the test is greater than that in the 50%-constant displacement repeated compression test.

The present inventors have found that, in order to obtain a network structure that allows the hardness to be retained in the 750 N-constant load repeated compression test, it is necessary to receive a load (750 N) applied from the outside, by the surface layer portion of the network structure, and disperse the load in the surface layer face to reduce a burden of the inner layer, and it is necessary to maintain the load dispersing effect by the surface layer face also during the constant load repeated compression test. The former can be achieved only by providing a difference in structure between the surface layer portion and the inner layer portion, and the latter can be achieved only by enhancing strength of contact points between the continuous linear structures in the surface layer portion. That is, the network structure having a low 50%-constant displacement repeated compression strain as has been conventionally known and the network structure of the present invention are different in that, the fiber diameter of the surface layer portion of the network structure is made greater than the fiber diameter of the inner layer portion thereof to provide a difference in structure between the surface layer portion and the inner layer portion, an area of the contact points between the continuous linear structures is increased to enhance the strength of the contact points in the surface layer portion of the network structure as compared to that in the inner layer portion, rupture of contact points is further inhibited from occurring during the repeated compression process, and the effect that the load (750 N) received during the repeated compression is dispersed at the surface of the surface layer portion is maintained by making fusion of continuous linear structures that form a network structure stronger to increase the strength of contact points between continuous linear structures in the network structure of the present invention. It is difficult to allow the 40% hardness retention after 750 N-constant load repeated compression to stably become not less than 55% only by enhancing the strength of contact points between the continuous linear structures that form the network structure. Therefore, the fiber diameter of the surface layer is selectively thickened and surface stiffness is enhanced, the strength of the contact points between the linear structures in the surface layer is designed so as to be high, and a difference in the structure between the inner layer and the surface layer is provided, thereby enabling stable achievement.

In order to obtain the network structure of the present invention, as described above, it is necessary to provide a difference in structure between the surface layer portion and the inner layer portion, and enhance the strength of contact points between the continuous linear structures of the surface layer portion. These can be achieved by setting the fiber diameter of the surface layer portion to be not less than 1.05 times of the fiber diameter of the inner layer portion. When the fiber diameter of the surface layer portion is less than 1.05 times of the fiber diameter of the inner layer portion, a difference in structure between the surface layer portion and the inner layer portion is small, and a necessary surface stiffness cannot be obtained. Therefore, an effect of dispersing a load received during the repeated compression at the surface of the surface layer portion is reduced, and sufficient hardness retention cannot be obtained. In the network structure described in Patent Document 3, a soft layer having a narrow fiber diameter is provided in the surface, and an inner layer in which the fiber diameter is thick so as to have durability is provided as the base layer, thereby improving cushioning performance and durability. In the present invention, the fiber diameter of the surface layer is thickened to enhance surface stiffness and improve hardness retention. Thus, the fundamental design concept is different therebetween. Further, although the manufacturing method described in Patent Document 3 is excellent conventionally for the 50%-constant displacement repeated compression, it is not necessarily excellent in the 750 N-constant load repeated compression durability that is tested more strictly and is to be achieved by the present invention, and it is difficult to achieve the scope of the present invention from the manufacturing method.

The network structure of the present invention preferably has characteristics that the compression-deflection coefficient is not less than 2.5. When the compression-deflection coefficient is in the above-described range, the network structure that gives good sitting or sleeping comfort can be obtained. In particular, it has been found that, in a case where the hardness is relatively high, when the compression-deflection coefficient is in the above-described range, the sitting or sleeping comfort can be improved. The compression-deflection coefficient is represented as a ratio between a 25% compression hardness and a 65% compression hardness, and the coefficient can be increased by either reduction of the 25% compression hardness or increase of the 65% compression hardness. Although a mechanism in which the compression-deflection coefficient is improved in the scope of the present invention has not been sufficiently clarified, the reason may be assumed to be as follows. That is, the network structure of the present invention has a large fiber diameter in the surface layer portion as described above and a high surface stiffness, and the 65% compression hardness is enhanced. This effect may allow the compression-deflection coefficient to be stably enhanced.

For example, the network structure of the present invention is obtained in the following manner. The network structure is obtained in accordance with a publicly known method described in Japanese Patent Application Publication No. H7-68061 etc. For example, the at least one thermoplastic elastomer selected from the group consisting of the polyester-based thermoplastic elastomer, the polyolefin-based thermoplastic elastomer, and the ethylene-vinyl acetate copolymer is distributed to nozzle orifices from a multi-row nozzle having a plurality of orifices, and discharged downward through the nozzle at a spinning temperature higher by not less than 20° C. and less than 120° C. than the melting point of at least one thermoplastic elastomer selected from the group consisting of the polyester-based thermoplastic elastomer, the polyolefin-based thermoplastic elastomer, and the ethylene-vinyl acetate copolymer. The continuous linear structures are mutually contacted in a molten state and thereby fused to form a three-dimensional structure, which is sandwiched by a take-up conveyor net, cooled by cooling water in a cooling bath, then drawn out, and drained or dried to obtain a network structure having both surfaces or one surface smoothed. When only one surface is to be smoothed, the at least one thermoplastic elastomer having been selected may be discharged onto an inclined take-up net, and the continuous linear structures may be mutually contacted in a molten state and thereby fused to form a three-dimensional structure, which may be cooled while the form of only the take-up net surface is relaxed. The obtained network structure can also be subjected to annealing treatment. Drying treatment of the network structure may be performed by annealing treatment.

For obtaining the network structure of the present invention, fusion of continuous linear structures of a network structure to be obtained should be made strong to increase the strength of contact points between the continuous linear structures. By increasing the strength of contact points between continuous linear structures that form the network structure, repeated compression durability of the network structure can be resultantly improved.

As one of means for obtaining a network structure with an increased strength of contact points, for example, the spinning temperature of at least one thermoplastic elastomer selected from the group consisting of the polyester-based thermoplastic elastomer, the polyolefin-based thermoplastic elastomer, and the ethylene-vinyl acetate copolymer preferably increases. The spinning temperature is changed depending on properties of the resin. In the present invention, the spinning temperature is preferably higher by at least not less than 30° C. and not more than 150° C. than the melting point, more preferably higher by not less than 40° C. and not more than 140° C. than the melting point, still more preferably higher by not less than 50° C. and not more than 130° C. than the melting point.

As a preferable method for providing a difference in fiber diameter between the surface layer portion and the inner layer portion in the network structure of the present invention, for example, a method in which the cooling of only the fiber in the surface of the network structure is advanced to increase the fiber diameter only in the surface layer portion, may be used. By the method for providing a difference in fiber diameter by a nozzle structure in which the hole diameters of the nozzle are made different between the surface layer portion and the inner layer portion to increase the fiber diameter in only the surface layer portion as described in Patent Document 3, it arises a problem in quality that strain and difference in denseness are made clear in the loop shape of the surface layer portion, or a problem in production such as production stability or uniform production since the balance in discharge between the surface layer portion and the inner layer portion is likely to be reduced, and it is difficult to obtain an excellent 750 N-constant load repeated compression durability that is to be achieved by the present invention.

As an approach for cooling only the fiber in the surface of the network structure, for example, a method in which an ambient temperature is set to be low, or a method in which cooling air is selectively blown onto the surface, may be used. In the present invention, the ambient temperature represents a temperature measured by a thermometer that is located in the same room as the spinning machine, is distant from the spinning machine by not less than 1 m and less than 1.5 m, and is located at the height between the discharge surface and the water surface. When the fiber in the surface layer is cooled at the ambient temperature, the ambient temperature is preferably not higher than 50° C., more preferably not higher than 40° C., still more preferably not higher than 35° C. In order to prevent significant reduction of the strength of contact points, the ambient temperature is preferably not less than −10° C. In a case where cooling air is selectively blown onto the surface, the temperature of the cooling air is preferably not higher than a melting point of the resin, and preferably not less than the ambient temperature. Further, designing is preferably made such that the cooling air flows downward due to entrained flow on the surface, or air having been subjected to heat exchange with the fiber in the surface and having an increased temperature is caused to flow into the inner layer so as not to reduce the strength of contact points in the inner layer even if the air has flowed into the inner layer. In this viewpoint, cooling in the fiber direction is preferably prevented from being positively performed. The speed of the cooling air is preferably not more than 0.3 m/second, more preferably not more than 0.2 min/second. By using the above-described methods singly or in combination of two or more, the fiber diameter of the surface layer portion can be made greater than the fiber diameter of the inner layer portion.

A device for blowing the cooling air is preferably configured to blow the cooling air in the thickness direction from both surfaces so as to cover the entirety in the width direction, of the network structure. According to the network structure to be obtained, the device for blowing cooling air can be selected as appropriate. A place, in the height direction, in which the device for blowing the cooling air is installed may be any place between the nozzle surface and the cooling water, and the height at which the device is installed may be changed as appropriate. The height may not be entirely the same in the width direction, and may be partially changed. The cooling air may be blown onto only a portion at which the surface is to be formed so as to be stronger, may be blown onto only one surface depending on an application, or blown from the entirety of the surface in the thickness direction of the network structure. At least one flow regulator such as a wire mesh is preferably provided such that the speed of the cooling air is as uniform as possible. In order to increase the temperature of the cooling air, a hot air generation device is preferably used, and waste heat near the nozzle may be used.

The continuous linear structure that forms the network structure of the present invention may be formed as a complex linear structure obtained by combination with other thermoplastic resins within the bounds of not impairing the object of the present invention. When the linear structure itself is complexed, examples of the complexed form include complex linear structures of sheath-core type, side-by-side type and eccentric sheath-core type.

The network structure of the present invention may be formed as a multilayered structure within the bounds of not impairing the object of the present invention. Examples of the method for forming a multilayered structure include methods in which network structures are stacked on one after another, and fixed by side ground etc., melted and fixed by heating, bonded with an adhesive, or bound by sewing or a band.

The shape of the cross-section of the continuous linear structure that forms the network structure of the present invention is not particularly limited, but when the cross-section is a hollow cross section and/or a modified cross section, preferred compression resistance and touch characteristics can be imparted.

The network structure of the present invention can be processed into a molded article from a resin manufacture process within the bounds of not deteriorating performance, and treated or processed by addition of chemicals, etc. to impart functions such as antibacterial deodorization, deodorization, mold prevention, coloring, fragrance, flame resisting, and absorption and desorption of moisture.

The network structure of the present invention thus obtained has excellent repeated compression durability with a low repeated compression residual strain and a high hardness retention.

EXAMPLES

Although the present invention will be described in detail with reference to examples, the present invention is in no way limited to them. Measurement and evaluation of characteristic value in examples were performed by following methods.

(1) Fiber Diameter

A sample is cut into a size of 20 cm×20 cm, and a linear structure having a length of about 5 mm is collected at 10 portions of each of the surface layer portion and the inner layer portion of the network structure. The surface layer portion fiber is collected from the outermost layer in the thickness direction, of the network structure, that is, from a portion of the fiber outward of which no fiber is present. The inner layer portion fiber is collected in a range of not more than 30% of the thickness based on the center portion in the thickness direction, of the network structure. The fiber diameter of each of the linear structures collected from the 10 portions of each of the surface layer portion and the inner layer portion is measured at an appropriate magnification by an optical microscope by focusing on the fiber diameter measurement portion. The fiber diameter obtained from the surface layer portion fiber is regarded as the fiber diameter of the surface layer portion, and the fiber diameter obtained from the inner layer portion fiber is regarded as the fiber diameter of the inner layer portion (unit: mm).

(2) Sample Thickness and Apparent Density

A sample is cut into a size of 40 cm×40 cm, the cut sample is kept standing with no load for 24 hours, and then measured for the height at 4 points using a thickness gauge Model FD-80N manufactured KOBUNSHII KEIKI CO., LTD., and the average of the measured values is determined as the sample thickness. The sample weight is measured by placing the sample on an electronic balance. The volume is determined from the sample thickness, and the sample weight is divided by the volume to obtain a value as the apparent density (average of n=4 in each case).

(3) Melting Point (Tm)

An endothermic peak (melting peak) temperature was determined from an endothermic/exothermic curve obtained by measurement at a heating rate of 20° C./min using a differential scanning calorimeter Q200 manufactured by TA Instruments.

(4) 70° C.-Compression Residual Strain

A sample is cut into a size of 30 cm×30 cm, and the cut sample is measured for a thickness (a) before treatment using the method described in (2). The sample, whose thickness has been measured, is sandwiched in a tool capable of being held in a 50%-compression state, placed in a dryer set at 70° C., and kept standing for 22 hours.

Thereafter, the sample is taken out, and cooled to remove a compressive strain, a thickness (b) after standing for 1 day is determined, and the compression residual strain is calculated in accordance with the formula: $\{(a)-(b)\}/(a)\times100$ from the thickness (b) and the thickness (a) before treatment (unit: %) (average of n=3).

(5) 25%-, 40%-, and 65%-Compression Hardness

A sample was cut into a size of 40 cm×40 cm. The sample was left under no load and an environment of 23° C.±2° C. for 24 hours, and then measurement was performed according to ISO 2439 (2008) E method, using autograph AG-X plus manufactured by SHIMADZU CORPORATION, under an environment of 23° C.±2° C. The sample was arranged so that a pressure plate of φ200 mm came to the sample center, and the thickness when the load was 5 N was measured, and referred to as an initial thickness with a hardness tester. With the position of the pressure plate at this time as the zero point, pre-compression was once carried out at a rate of 100 mm/min up to 75% of the initial thickness with a hardness tester, and the pressure plate was returned to the zero point at the same speed and then left as it was for 4 minutes. Immediately after the predetermined time passed, compression was carried out to 25%, 40% and 65% of the initial thickness with a hardness tester at a rate of 100 mm/min, and the load at that time was measured, and referred to as a 25%-compression hardness, a 40%-compression hardness, and a 65%-compression hardness, respectively: unit N/φ200 (average value of n=3).

(6) Residual Strain after 750 N-Constant Load Repeated Compression

A sample is cut into a size of 40 cm×40 cm, and an initial hardness-meter thickness (c) is measured by using the method described in (5). Thereafter, the sample, whose thickness has been measured, is subjected to 750 N-constant load repeated compression by using ASKER STM-536 in compliance with the JIS K6400-4 (2004) A method (constant load method). As a presser, a presser which has a circular shape, and in which an edge portion of the bottom surface has a radius of curvature of 25±1 mm, the diameter is 250±1 mm, and the lower surface is flat, is used. The load is 750 N±20N, the frequency of the compression is 70±5 times/minute, the number of times of the compression is 80000, and a time in which pressurizing at the maximum load of 750±20N is performed is not more than 25% of a time required for repeated compression. After the end of the repeated compression, the test piece is left as it is for 10±0.5 minutes in a state where no force is applied, and, by using Autograph AG-X plus manufactured by SHIMADZU CORPORATION, the sample is placed so as to align a φ200 mm compression board with the center of the sample, and the thickness at the load of 5 N is measured as a hardness-meter thickness (d) after repeated compression. The residual strain is calculated by using the initial hardness-meter thickness (c) and the hardness-meter thickness (d) after repeated compression according to the expression $\{(c)-(d)\}/(c)\times100$: the unit is % (average of n=3).

(7) 40%-Compression Hardness Retention after 750 N-Constant Load Repeated Compression A sample is cut into a size of 40 cm×40 cm, and an initial hardness-meter thickness and a 40% compression hardness (e) are measured by using the method described in (5). Thereafter, the sample for which the measurement has been made is subjected to 750 N-constant load repeated compression by using ASKER STM-536 in compliance with the JIS K6400-4 (2004) A method (constant load method). As a presser, a presser which has a circular shape, and in which an edge portion of the bottom surface has a radius of curvature of 25±1 mm, the diameter is 250±1 mm, and the lower surface is flat, is used. The load is 750 N±20N, the frequency of the compression is 70±5 times/minute, the number of times of the compression is 80000, and a time in which pressurizing at the maximum load of 750±20N is performed is not more than 25% of a time required for repeated compression. After the end of the repeated compression, the test piece is left as it is for 10±0.5 minutes in a state where no force is applied. By using Autograph AG-X plus manufactured by SHIMADZU CORPORATION, the sample is placed so as to align a φ200 mm compression board with the center of the sample, an initial hardness-meter thickness before 750 N-constant load repeated compression is defined as a zero point for the thickness of the sample, and the sample is preliminarily compressed once to 75% of the initial hardness-meter thickness at a speed of 100 mm/min., followed by returning the compression board to the zero point at the same speed, and the sample is left as it is for four minutes. Immediately after elapse of a predetermined time, the sample is compressed to 40% of the initial hardness-meter thickness at a speed of 100 mm/min., and a load at this time is measured as a 40%-compression hardness (f) after 750 N-constant load repeated compression. The 40%-compression hardness retention after 750 N-constant load repeated compression is calculated according to the expression $(f)/(e)\times100$: the unit is % (average of n=3).

(8) 65%-Compression Hardness Retention after 750 N-Constant Load Repeated Compression A sample is cut into a size of 40 cm×40 cm, and an initial hardness-meter thickness and a 65% compression hardness (g) are measured by using the method described in (5). Thereafter, the sample for which the measurement has been made is subjected to 750 N-constant load repeated compression by using ASKER STM-536 in compliance with the JIS K6400-4 (2004) A method (constant load method). As a presser, a presser which has a circular shape, and in which an edge portion of the bottom surface has a radius of curvature of 25±1 mm, the diameter is 250±1 mm, and the lower surface is flat, is used. The load is 750 N±20N, the frequency of the compression is 70±5 times/minute, the number of times of the compression is 80000, and a time in which pressurizing at the maximum load of 750±20N is performed is not more than 25% of a time required for repeated compression. After the end of the repeated compression, the test piece is left as it is for 10±0.5 minutes in a state where no force is applied. By using Autograph AG-X plus manufactured by SHIMADZU CORPORATION, the sample is placed so as to align a φ200 mm compression board with the center of the sample, an initial hardness-meter thickness before 750 N-constant load repeated compression is defined as a zero point for the thickness of the sample, and the sample is preliminarily compressed once to 75% of the initial hardness-meter thickness at a speed of 100 mm/min., followed by returning the compression board to the zero point at the same speed, and the sample is left as it is for four minutes. Immediately after elapse of a predetermined time, the sample is compressed to 40% of the initial hardness-meter thickness at a speed of 100 mm/min., and a load at this time is measured as a 65%-compression hardness (h) after 750 N-constant load repeated compression. The 65%-compression hardness retention after 750 N-constant load repeated compression is calculated according to the expression $(h)/(g)\times100$: the unit is % (average of n=3).

(9) Compression-Deflection Coefficient

A sample is cut into a size of 40 cm×40 cm, and the cut sample is kept standing under an environment of 23° C.±2° C. with no load for 24 hours, and measurement is made by using Autograph AG-X plus manufactured by SHIMADZU CORPORATION which is placed under an environment of 23° C.±2° C., in compliance with the ISO2439 (2008) E method. The sample is placed so as to align a φ200 mm compression board with the center of the sample, and the thickness at the load of 5 N is measured as an initial hardness-meter thickness. The position of the compression board at this time is defined as a zero point, and the sample is preliminarily compressed once to 75% of the initial hardness-meter thickness at a speed of 100 mm/min., followed by returning the compression board to the zero point at the same speed, and the sample is left as it is for four minutes. Immediately after elapse of a predetermined time, the sample is compressed to 25% to 65% of the initial hardness-meter thickness at a speed of 100 mm/min., and loads at this time are measured as a 25%-compression hardness (i) and a 65%-compression hardness (j). The compression-deflection coefficient is calculated according to the expression (j)/(i) (average of n=13).

[Production of Polyester-Based Thermoplastic Elastomer]

As a polyester-based thermoplastic elastomer, dimethyl terephthalate (DMT) and 1,4-butanediol (1,4-BD) were charged together with a small amount of a catalyst, transesterification was performed using a usual method, polytetramethylene glycol (PTMG) was then added, and the mixture was subjected to polycondensation while the temperature was raised and the pressure was reduced, so that a polyether ester block copolymer elastomer was generated. Then, 2% of an antioxidant was added thereto, and the mixture was mixed and kneaded, then pelletized, and dried in vacuum at 50° C. for 48 hours to obtain a thermoplastic elastic resin raw material. The formulation of the obtained thermoplastic elastic resin raw material is shown in Table 1.

TABLE 1

| | Hard segment | | Soft segment | | | |
|---|---|---|---|---|---|---|
| Experimental No. | Components | Glycol components | Components | Number average molecular weight | Content | Melting point (° C.) |
| A-1 | DMT | 1,4-BD | PTMG | 1000 | 28 | 205 |
| A-2 | DMT | 1,4-BD | PTMG | 1000 | 58 | 162 |
| A-3 | DMT | 1,4-BD | PTMG | 2000 | 52 | 166 |

Example 1-1

The obtained thermoplastic elastic resin A-1 was discharged to downward from a nozzle at a spinning temperature of 260° C. and a speed of 0.85 g/min. in terms of discharge amount per single hole through orifices each having a hole diameter of 1.0 mm and staggered-arranged at a pitch between holes of 5 mm on a nozzle effective face of 1050 mm in the width direction and 50 mm in width in the thickness direction. Cooling water was arranged at a position 23 cm below the nozzle face through a cooling space at an ambient temperature of 30° C. without blowing of cooling air. Endless nets made of stainless steel each having a width of 150 cm were disposed parallel at an interval of 45 mm in opening width to form a pair of take-up conveyors so as to be partially exposed over a water surface. The discharged filaments in a molten state were curled to form loops, and contact parts were fused to form a three-dimensional network structure. The network structure in a molten state was sandwiched at both surfaces by the take-up conveyors, and drawn into cooling water at a speed of 0.8 m per minute, thereby solidified, flattened at both surfaces, then cut into a predetermined size, and dried/heat-treated with hot air at 110° C. for 15 minutes to obtain a network structure. The properties of the obtained network structure formed of the thermoplastic elastic resin are shown in Table 2.

The obtained network structure was formed of filaments such that the fiber diameter of the surface layer portion was 0.53 mm and the fiber diameter of the inner layer portion was 0.48 mm, and, in the network structure, an apparent density was 0.055 g/cm$^3$, a thickness of flattened surface was 45 mm, a 70° C.-compression residual strain was 9.7%, a 25%-compression hardness was 204 N/φ200 mm, a 40%-compression hardness was 260 N/φ200 mm, a 65%-compression hardness was 548 N/φ200 mm, a 750 N repeated compression residual strain was 7.4%, a 40%-compression hardness retention after 750 N repeated compression was 62.3%, a 65%-compression hardness retention after 750 N repeated compression was 78.8%, and a compression-deflection coefficient was 2.7. The obtained network structure satisfied the requirements of the present invention, and had excellent repeated compression durability.

Example 1-2

A network structure was obtained in the same manner as in Example 1-1 except that: a nozzle in which orifices each had an outer diameter of 2.0 mm and an inner diameter of 1.6 mm, and had a triple bridge hollow forming cross section were staggered-arranged at a pitch between holes of 5 mm, was used; the spinning temperature was 260° C.; the discharge amount per single hole was 1.8/min.; the ambient temperature was 40° C.; the temperature of cooling air was 100° C.; the speed of the cooling air was 0.2 m/sec.; the take-up speed was 1.5 m/min.; and the nozzle face-cooling water distance was 28 cm. The properties of the obtained network structure formed of the thermoplastic elastic resin are shown in Table 2.

The obtained network structure was formed of filaments such that the fiber diameter of the surface layer portion was 0.57 mm and the fiber diameter of the inner layer portion was 0.50 mm, and, in the network structure, an apparent density was 0.059 g/cm$^3$, a thickness of flattened surface was 45 mm, a 70° C.-compression residual strain was 13.1%, a 25%-compression hardness was 310 N/φ200 mm, a 40%-compression hardness was 399 N/φ200 mm, a 65%-compression hardness was 924 N/φ200 mm, a 750 N repeated compression residual strain was 7.7%, a 40%-hardness retention after 750 N repeated compression was 73.4%, a 65%-hardness retention after 750 N repeated compression was 82.0%, and a compression-deflection coefficient was 3.0. The obtained network structure satisfied the requirements of the present invention, and had excellent repeated compression durability.

Example 1-3

A network structure was obtained in the same manner as in Example 1-2 except that the thermoplastic elastic resin was A-2, the spinning temperature was 240° C., the temperature of cooling air was 80° C., the speed of cooling air was 0.1 m/sec., the take-up speed was 1.6 m/min., and the nozzle face-cooling water distance was 25 cm. The properties of the obtained network structure formed of the thermoplastic elastic resin are shown in Table 2.

The obtained network structure was formed of filaments such that the fiber diameter of the surface layer portion was 0.65 mm and the fiber diameter of the inner layer portion was 0.57 mm, and, in the network structure, an apparent density was 0.055 g/cm$^3$, a thickness of flattened surface was 45 mm, a 70° C.-compression residual strain was 10.8%, a 25%-compression hardness was 105 N/φ200 mm, a 40%-compression hardness was 177 N/φ200 mum, a 65%-compression hardness was 399 N/φ200 mm, a 750 N repeated compression residual strain was 6.9%, a 40%-hardness retention after 750 N repeated compression was 71.0%, a 65%-hardness retention after 750 N repeated compression was 87.7%, and a compression-deflection coefficient was 3.8. The obtained network structure satisfied the requirements of the present invention, and had excellent repeated compression durability.

Example 1-4

A network structure was obtained in the same manner as in Example 1-2 except that the thermoplastic elastic resin was A-3, the spinning temperature was 240° C., the ambient temperature was 20° C., the temperature of cooling air was 80° C., the speed of cooling air was 0.1 m/sec., the take-up speed was 1.2 m/min., the nozzle face-cooling water distance was 30 cm, and the opening width of the conveyor net was 40 mm. The properties of the obtained network structure formed of the thermoplastic elastic resin are shown in Table 2.

The obtained network structure was formed of filaments such that the fiber diameter of the surface layer portion was 0.80 mm and the fiber diameter of the inner layer portion was 0.75 mm, and, in the network structure, an apparent density was 0.054 g/cm$^3$, a thickness of flattened surface was 40 mm, a 70° C.-compression residual strain was 12.2%, a 25%6-compression hardness was 80 N/φ200 mm, a 40%-compression hardness was 134 N/φ200 mm, a 65%-compression hardness was 296 N/φ200 mm, a 750 N repeated compression residual strain was 8.8%, a 40%-hardness retention after 750 N repeated compression was 65.5%, a 65%-hardness retention after 750 N repeated compression was 73.3%, and a compression-deflection coefficient was 3.7. The obtained network structure satisfied the requirements of the present invention, and had excellent repeated compression durability.

Comparative Example 1-1

A network structure was obtained in the same manner as in Example 1-2 except that the thermoplastic elastic resin was A-1, the spinning temperature was 230° C., the discharge amount per single hole was 1.1 g/min., the ambient temperature was 50° C., no cooling air was blown, the take-up speed was 1.2 m/min., the nozzle face-cooling water distance was 26 cm, and the opening width of the conveyor net was 40 mm. The properties of the obtained network structure formed of the thermoplastic elastic resin are shown in Table 2.

The obtained network structure was formed of filaments such that the fiber diameter of the surface layer portion was 1.00 mm and the fiber diameter of the inner layer portion was 0.96 mm, and, in the network structure, an apparent density was 0.041 g/cm$^3$, a thickness of flattened surface was 40 mm, a 70° C.-compression residual strain was 12.8%, a 25%-compression hardness was 190 N/φ200 mm, a 40%-compression hardness was 250 N/φ200 mm, a 65%-compression hardness was 445 N/φ200 mm, a 750 N repeated compression residual strain was 9.1%, a 40%-hardness retention after 750 N repeated compression was 54.0%, a 65%-hardness retention after 750 N repeated compression was 68.2%, and a compression-deflection coefficient was 2.3. The obtained network structure did not satisfy the requirements of the present invention, and had poor repeated compression durability.

Comparative Example 1-2

A network structure was obtained in the same manner as in Example 1-1 except that the thermoplastic elastic resin was A-2, the spinning temperature was 210° C., the discharge amount per single hole was 0.8 g/min., the ambient temperature was 40° C., no cooling air was blown, the take-up speed was 0.8 m/min., the nozzle face-cooling water distance was 25 cm, and the opening width of the conveyor net was 40 mm. The properties of the obtained network structure formed of the thermoplastic elastic resin are shown in Table 2.

The obtained network structure was formed of filaments such that the fiber diameter of the surface layer portion was 0.44 mm and the fiber diameter of the inner layer portion was 0.43 mm, and, in the network structure, an apparent density was 0.055 g/cm$^3$, a thickness of flattened surface was 40 mm, a 70° C.-compression residual strain was 18.6%, a 25%6-compression hardness was 174 N/φ200 mm, a 40%-compression hardness was 224 N/φ200 mm, a 65%-compression hardness was 424 N/φ200 mm, a 750 N repeated compression residual strain was 4.1%, a 40%-hardness retention after 750 N repeated compression was 53.3%, a 65%-hardness retention after 750 N repeated compression was 63.1%, and a compression-deflection coefficient was 2.4. The obtained network structure did not satisfy the requirements of the present invention, and had poor repeated compression durability.

Comparative Example 1-3

A network structure was obtained in the same manner as in Example 1-2 except for the following points. That is, on the nozzle effective face of 500 mm in the width direction and 50 mm in width in the thickness direction, a nozzle had: orifices, in the first to the eighth lines in the thickness direction, in each of which a hole diameter was 1.0 mm, a pitch between holes in the thickness direction was 5 mm, and a pitch between holes in the width direction was 10 mm; and orifices, in the ninth to the eleventh lines in the thickness direction, in each of which a hole diameter was 0.7 mm, a pitch between holes in the thickness direction was 5 mm, and a pitch between holes in the width direction was 2.5 mm. Further, the thermoplastic elastic resin was A-3, the spinning temperature was 210° C., the discharge amount per single hole was 1.0 g/min., the ambient temperature was 40° C., no cooling air was blown, the take-up speed was 1.0 m/min., the nozzle face-cooling water distance was 20 cm, and the opening width of the conveyor net was 40 mm. The properties of the obtained network structure formed of the thermoplastic elastic resin are shown in Table 2.

The obtained network structure was formed of filaments such that the fiber diameter of the surface layer portion was 1.04 mm and the fiber diameter of the inner layer portion was 0.51 mm, and, in the network structure, an apparent density was 0.050 g/cm$^3$, a thickness of flattened surface was 40 mm, a 70° C.-compression residual strain was 10.4%, a 25%-compression hardness was 65 N/φ200 mm, a 40%-compression hardness was 127 N/φ200 mm, a 65%-compression hardness was 190 N/φ200 mm, a 750 N repeated compression residual strain was 7.0%, a 40%-hardness retention after 750 N repeated compression was 53.9%, a 65%-hardness retention after 750 N repeated compression was 64.8%, and a compression-deflection coefficient was 2.9. The obtained network structure did not satisfy the requirements of the present invention, and had poor repeated compression durability.

TABLE 2

| Item | Example 1-1 | Example 1-2 | Example 1-3 | Example 1-4 | Comparative Example 1-1 | Comparative Example 1-2 | Comparative Example 1-3 |
|---|---|---|---|---|---|---|---|
| Thermoplastic elastic resin | A-1 | A-1 | A-2 | A-3 | A-1 | A-2 | A-3 |
| Spinning temperature (° C.) | 260 | 260 | 240 | 240 | 230 | 210 | 210 |
| Discharge amount per single hole (g/min) | 0.85 | 1.8 | 1.8 | 1.6 | 1.1 | 0.8 | 1.0 |
| Ambient temperature (° C.) | 30 | 40 | 40 | 20 | 50 | 40 | 40 |
| Temperature of cooling air (° C.) | — | 100 | 80 | 80 | — | — | — |
| Speed of cooling air (m/sec) | 0 | 0.2 | 0.1 | 0.1 | 0 | 0 | 0 |
| Take-up speed (m/min) | 0.8 | 1.5 | 1.6 | 1.2 | 1.2 | 0.8 | 1.0 |
| Nozzle face-cooling water distance (cm) | 23 | 28 | 25 | 30 | 26 | 25 | 20 |
| Apparent density (g/cm$^3$) | 0.055 | 0.059 | 0.055 | 0.054 | 0.041 | 0.055 | 0.050 |
| Thickness (mm) | 45 | 45 | 45 | 40 | 40 | 40 | 40 |
| Fiber diameter of the surface layer portion (mm) | 0.53 | 0.57 | 0.65 | 0.80 | 1.00 | 0.44 | 1.04 |
| Fiber diameter of the inner layer portion (mm) | 0.48 | 0.50 | 0.57 | 0.75 | 0.96 | 0.43 | 0.51 |
| Surface layer fiber diameter/Inner layer fiber diameter (times) | 1.10 | 1.14 | 1.14 | 1.07 | 1.04 | 1.02 | 2.04 |
| 70° C.-Compression Residual Strain (%) | 9.7 | 13.1 | 10.8 | 12.2 | 12.8 | 18.6 | 10.4 |
| 25%-compression hardness (N/φ200 mm) | 204 | 310 | 105 | 80 | 190 | 174 | 65 |
| 40%-compression hardness (N/φ200 mm) | 260 | 399 | 177 | 134 | 250 | 224 | 127 |
| 65%-compression hardness (N/φ200 mm) | 548 | 924 | 399 | 296 | 445 | 424 | 190 |
| 750N-constant load repeated compression residual strain (%) | 7.4 | 7.7 | 6.9 | 8.8 | 9.1 | 4.1 | 7.0 |
| 40%-hardness retention after 750N-constant load repeated compression (%) | 62.3 | 73.4 | 71.0 | 65.5 | 54.0 | 53.3 | 53.9 |
| 65%-hardness retention after 750N-constant load repeated compression (%) | 78.8 | 82.0 | 87.7 | 73.3 | 68.2 | 63.1 | 64.8 |
| Compression-deflection coefficient | 2.7 | 3.0 | 3.8 | 3.7 | 2.3 | 2.4 | 2.9 |

[Production of Polyolefin-Based Thermoplastic Elastomer]

An ethylene-α-olefin copolymer was obtained by ethylene and hexene-1 being polymerized in a publicly known method using hexane as a solvent and a metallocene compound as a catalyst. Then, 2% of an antioxidant was added thereto, and the mixture was mixed and kneaded, then pelletized to obtain a polyolefin-based thermoplastic elastomer (B-1). The obtained polyolefin-based thermoplastic elastomer (B-1) had a specific gravity of 0.919 g/cm$^3$ and a melting point of 110° C.

An ethylene-α-olefin copolymer was obtained by ethylene and propylene being polymerized in a publicly known method using hexane as a solvent and a metallocene compound as a catalyst. Then, 2% of an antioxidant was added thereto, and the mixture was mixed and kneaded, then pelletized to obtain a polyolefin-based thermoplastic elastomer (B-2). The obtained polyolefin-based thermoplastic elastomer (B-2) had a specific gravity of 0.887 g/cm$^3$ and a melting point of 155° C.

Example 2-1

The obtained polyolefin-based thermoplastic elastomer B-1 was discharged to downward from a nozzle at a spinning temperature of 200° C. and a speed of 1.0 g/min. in terms of discharge amount per single hole through orifices each having a hole diameter of 0.8 mm and staggered-arranged at a pitch between holes of 5 mm on a nozzle effective face of 1050 mm in the width direction and 60 mm in width in the thickness direction. Cooling water was arranged at a position 22 cm below the nozzle face through a cooling space at an ambient temperature of 20° C. without blowing of cooling air. Endless nets made of stainless steel each having a width of 150 cm were disposed parallel at an interval of 45 mm in opening width to form a pair of take-up conveyors so as to be partially exposed over a water surface. The discharged filaments in a molten state were curled to form loops, and contact parts were fused to form a three-dimensional network structure. The network structure in a molten state was sandwiched at both surfaces by the take-up conveyors, and drawn into cooling water at a speed of 0.9 m per minute, thereby solidified, flattened at both surfaces, then cut into a predetermined size, and dried/heat-treated with hot air at 70° C. for 15 minutes to obtain a network structure. The properties of the obtained network structure formed of the polyolefin-based thermoplastic elastomer (B-1) are shown in Table 3.

The obtained network structure was formed of filaments with a solid cross-sectional shape such that the fiber diameter of the surface layer portion was 0.52 mm and the fiber diameter of the inner layer portion was 0.48 mm, and, in the network structure, an apparent density was 0.061 g/cm$^3$, a thickness of flattened surface was 46 mm, a 25%-compression hardness was 155 N/φ200 mm, a 40%-compression hardness was 225 N/φ200 mm, a 65%-compression hardness was 470 N/φ200 mm, a 750 N repeated compression residual strain was 8.0%, a 40%-compression hardness retention after 750 N repeated compression was 61.2%, a 65%-compression hardness retention after 750 N repeated compression was 74.2%, and a compression-deflection coefficient was 3.0. The obtained network structure satisfied the requirements of the present invention, and had excellent repeated compression durability.

Example 2-2

The polyolefin-based thermoplastic elastomer B-1 was discharged to downward from a nozzle at a spinning temperature of 210° C. and a speed of 1.5 g/min. in terms of discharge amount per single hole through orifices each having an outer diameter of 2 mm, an inner diameter of 1.6 mm, a triple bridge hollow forming cross section, and staggered-arranged at a pitch between holes of 5 mm on a nozzle effective face of 1050 mm in the width direction and 60 mm in width in the thickness direction. Cooling water was arranged at a position 30 cm below the nozzle face through a cooling space in a condition that an ambient temperature is 20° C., the temperature of cooling air is 100° C., and the speed of the cooling air was 0.2 m/sec. Endless nets made of stainless steel each having a width of 150 cm were disposed parallel at an interval of 45 mm in opening width to form a pair of take-up conveyors so as to be partially exposed over a water surface. The discharged filaments in a molten state were curled to form loops, and contact parts were fused to form a three-dimensional network structure. The network structure in a molten state was sandwiched at both surfaces by the take-up conveyors, and drawn into cooling water at a speed of 1.6 m per minute, thereby solidified, flattened at both surfaces, then cut into a predetermined size, and dried/heat-treated with hot air at 70° C. for 15 minutes to obtain a network structure. The properties of the obtained network structure formed of the polyolefin-based thermoplastic elastomer (B-1) are shown in Table 3.

The obtained network structure was formed of filaments such that the cross-sectional shape is a hollow cross-sectional shape, the degree of hollowness is 25%, the fiber diameter of the surface layer portion was 0.71 mm and the fiber diameter of the inner layer portion was 0.65 mm, and, in the network structure, an apparent density was 0.053 g/cm$^3$, a thickness of flattened surface was 46 mm, a 25%-compression hardness was 185 N/φ200 mm, a 40%-compression hardness was 242 N/φ200 mm, a 65%-compression hardness was 573 N/φ200 mm, a 750 N repeated compression residual strain was 8.0%, a 40%-compression hardness retention after 750 N repeated compression was 66.4%, a 65%-compression hardness retention after 750 N repeated compression was 79.1%, and a compression-deflection coefficient was 3.1. The obtained network structure satisfied the requirements of the present invention, and had excellent repeated compression durability.

Example 2-3

A network structure was obtained by treatment being performed in the same manner as in Example 2-2 except that the ambient temperature in the cooling space was 15° C., and the interval in the opening width of the endless net was 40 mm. The properties of the obtained network structure formed of the polyolefin-based thermoplastic elastomer (B-1) are shown in Table 3.

The obtained network structure was formed of filaments such that the cross-sectional shape is a hollow cross-sectional shape, the degree of hollowness is 25%, the fiber diameter of the surface layer portion was 0.76 mm and the fiber diameter of the inner layer portion was 0.68 mm, and, in the network structure, an apparent density was 0.060 g/cm$^3$, a thickness of flattened surface was 41 mm, a 25%-compression hardness was 208 N/φ200 mm, a 40%-compression hardness was 279 N/φ200 mm, a 65%-compression hardness was 629 N/φ200 mm, a 750 N repeated compression residual strain was 7.9%, a 40%-hardness retention after 750 N repeated compression was 70.2%, a 65%-hardness retention after 750 N repeated compression was 80.1%, and a compression-deflection coefficient was 3.0. The obtained network structure satisfied the requirements of the present invention, and had excellent repeated compression durability.

Example 2-4

A network structure was obtained by treatment being performed in the same manner as in Example 2-3 except that the polyolefin-based thermoplastic elastomer (B-2) was used, and the spinning temperature was 230° C. The properties of the obtained network structure formed of the polyolefin-based thermoplastic elastomer (B-2) are shown in Table 3.

The obtained network structure was formed of filaments such that the cross-sectional shape is a hollow cross-sectional shape, the degree of hollowness is 22%, the fiber diameter of the surface layer portion was 0.69 mm and the fiber diameter of the inner layer portion was 0.60 mm, and, in the network structure, an apparent density was 0.060 g/cm$^3$, a thickness of flattened surface was 41 mm, a 25%-compression hardness was 215 N/φ200 mm, a 40%-compression hardness was 281 N/φ200 mm, a 65%-compression hardness was 645 N/φ200 mm, a 750 N repeated compression residual strain was 8.1%, a 40%-hardness retention after 750 N repeated compression was 72.1%, a 65%-hardness retention after 750 N repeated compression was 81.4%, and a compression-deflection coefficient was 3.0. The obtained network structure satisfied the requirements of the present invention, and had excellent repeated compression durability.

Comparative Example 2-1

A network structure was obtained in the same manner as in Example 2-1 except that the spinning temperature was 190° C., no cooling space was provided, and the opening width of an endless net made of stainless steel was 50 mm. The properties of the obtained network structure formed of the polyolefin-based thermoplastic elastomer are shown in Table 3.

The obtained network structure was formed of filaments with a solid cross-sectional shape such that the fiber diameter of the surface layer portion was 0.51 mm and the fiber diameter of the inner layer portion was 0.49 mm, and, in the network structure, an apparent density was 0.056 g/cm$^3$, a thickness of flattened surface was 50 mm, a 25%-compression hardness was 162 N/φ200 mm, a 40%-compression hardness was 216 N/φ200 mm, a 65%-compression hardness was 469 N/φ200 mm, a 750 N repeated compression residual strain was 8.9%, a 40%-hardness retention after 750 N repeated compression was 51.6%, a 65%-hardness retention after 750 N repeated compression was 67.6%, and a compression-deflection coefficient was 2.9. The obtained network structure did not satisfy the requirements of the present invention, and had slightly poor repeated compression durability.

Comparative Example 2-2

A network structure was obtained in the same manner as in Example 2-2 except that the spinning temperature was 190° C., no cooling space was provided, no cooling air was blown, and the opening width of an endless net made of stainless steel was 50 mm. The properties of the obtained network structure formed of the polyolefin-based thermoplastic elastomer are shown in Table 3.

The obtained network structure was formed of filaments such that the cross-sectional shape is a hollow cross-sectional shape, the degree of hollowness is 24%, the fiber diameter of the surface layer portion was 0.70 mm and the fiber diameter of the inner layer portion was 0.68 mm, and, in the network structure, an apparent density was 0.048 g/cm$^3$, a thickness of flattened surface was 50 mm, a 25%-compression hardness was 152 N/φ200 mm, a 40%-compression hardness was 219 N/φ200 mm, a 65%-compression hardness was 490 N/φ200 mm, a 750 N repeated compression residual strain was 11.3%, a 40%-hardness retention after 750 N repeated compression was 53.1%, a 65%-hardness retention after 750 N repeated compression was 68.9%, and a compression-deflection coefficient was poor and 2.4. The obtained cushion did not satisfy the requirements of the present invention, and had slightly poor repeated compression durability.

Comparative Example 2-3

A network structure was obtained by treatment being performed in the same manner as in Example 2-2 except that the polyolefin-based thermoplastic elastomer (B-2) was used. The properties of the obtained network structure formed of the polyolefin-based thermoplastic elastomer (B-2) are shown in Table 3.

The obtained network structure was formed of filaments such that the cross-sectional shape is a hollow cross-sectional shape, the degree of hollowness is 23%, the fiber diameter of the surface layer portion was 0.71 mm and the fiber diameter of the inner layer portion was 0.70 mm, and, in the network structure, an apparent density was 0.048 g/cm$^3$, a thickness of flattened surface was 50 mm, a 25%-compression hardness was 148 N/φ200 mm, a 40%-compression hardness was 213 N/φ200 mm, a 65%-compression hardness was 452 N/φ200 mm, a 750 N repeated compression residual strain was 12.1%, a 40%-hardness retention after 750 N repeated compression was 52.3%, a 65%-hardness retention after 750 N repeated compression was 68.2%, and a compression-deflection coefficient was 3.1. The obtained network structure satisfied the requirements of the present invention, and had excellent repeated compression durability.

TABLE 3

| Item | Example 2-1 | Example 2-2 | Example 2-3 | Example 2-4 | Comparative Example 2-1 | Comparative Example 2-2 | Comparative Example 2-3 |
|---|---|---|---|---|---|---|---|
| Polyolefin-based thermoplastic elastomer | B-1 | B-1 | B-1 | B-2 | B-1 | B-1 | B-2 |
| Spinning temperature (° C.) | 200 | 210 | 210 | 230 | 190 | 190 | 190 |

TABLE 3-continued

| Item | Example 2-1 | Example 2-2 | Example 2-3 | Example 2-4 | Comparative Example 2-1 | Comparative Example 2-2 | Comparative Example 2-3 |
|---|---|---|---|---|---|---|---|
| Discharge amount per single hole (g/min) | 1.0 | 1.5 | 1.5 | 1.5 | 1.0 | 1.5 | 1.5 |
| Ambient temperature (° C.) | 20 | 20 | 15 | 15 | — | — | — |
| Temperature of cooling air (° C.) | — | 50 | 50 | 50 | — | — | — |
| Speed of cooling air (m/sec) | — | 0.2 | 0.2 | 0.2 | — | — | — |
| Take-up speed (m/min) | 0.9 | 1.6 | 1.6 | 1.6 | 0.9 | 1.6 | 1.6 |
| Nozzle face-cooling water distance (cm) | 22 | 30 | 30 | 30 | 22 | 30 | 30 |
| Apparent density (g/cm$^3$) | 0.061 | 0.053 | 0.060 | 0.060 | 0.056 | 0.048 | 0.048 |
| Thickness (mm) | 46 | 46 | 41 | 41 | 50 | 50 | 50 |
| Cross-sectional shape of the fiber | Solid | Hollow | Hollow | Hollow | Solid | Hollow | Hollow |
| Degree of hollowness | — | 25 | 25 | 22 | — | 24 | 23 |
| Fiber diameter of the surface layer portion (mm) | 0.52 | 0.71 | 0.76 | 0.69 | 0.51 | 0.70 | 0.71 |
| Fiber diameter of the inner layer portion (mm) | 0.48 | 0.65 | 0.68 | 0.60 | 0.49 | 0.68 | 0.70 |
| Surface layer fiber diameter/Inner layer fiber diameter (times) | 1.08 | 1.09 | 1.12 | 1.15 | 1.04 | 1.03 | 1.01 |
| 25%-compression hardness (N/φ200 mm) | 155 | 185 | 208 | 215 | 162 | 152 | 148 |
| 40%-compression hardness (N/φ200 mm) | 225 | 242 | 279 | 281 | 216 | 219 | 213 |
| 65%-compression hardness (N/φ200 mm) | 470 | 573 | 629 | 645 | 469 | 490 | 452 |
| 750N-constant load repeated compression residual strain (%) | 8.0 | 8.0 | 7.9 | 8.1 | 8.9 | 11.3 | 12.1 |
| 40%-hardness retention after 750N-constant load repeats (%) | 61.2 | 66.4 | 70.2 | 72.1 | 51.6 | 53.1 | 52.3 |
| 65%-hardness retention after 750N-constant load repeats (%) | 74.2 | 79.1 | 80.1 | 81.4 | 67.6 | 68.9 | 68.2 |
| Compression-deflection coefficient | 3.0 | 3.1 | 3.0 | 3.0 | 2.9 | 2.4 | 3.1 |

[Production of Ethylene-Vinyl Acetate Copolymer]

An ethylene-vinyl acetate copolymer was obtained by radical copolymerization of ethylene with vinyl acetate being performed in a publicly known method. Then, 2% of an antioxidant was added thereto, and the mixture was mixed and kneaded, then pelletized to obtain the ethylene-vinyl acetate copolymer. A ratio of vinyl acetate at the polymerization was changed to obtain an ethylene-vinyl acetate copolymer C-1 in which the content of vinyl acetate was 10%, and an ethylene-vinyl acetate copolymer C-2 in which the content of vinyl acetate was 20%. The ethylene-vinyl acetate copolymer C-1 was such that the content of vinyl acetate was 10%, the specific gravity was 0.929, and the melting point was 95° C. The ethylene-vinyl acetate copolymer C-2 was such that the content of vinyl acetate was 20%, the specific gravity was 0.941, and the melting point was 85° C. The properties of the obtained polymers are shown in Table 4.

TABLE 4

| Experimental No. | Specific gravity (—) | Content of vinyl acetate (%) | Melting point (° C.) |
|---|---|---|---|
| C-1 | 0.929 | 10 | 95 |
| C-2 | 0.941 | 20 | 85 |

Example 3-1

The obtained ethylene-vinyl acetate copolymer C-1 was discharged to downward from a nozzle at a spinning temperature of 190° C. and a speed of 1.0 g/min. in terms of discharge amount per single hole through orifices each having a hole diameter of 0.8 mm and staggered-arranged at a pitch between holes of 5 mm on a nozzle effective face of 1050 mm in the width direction and 60 mm in width in the thickness direction. Cooling water was arranged at a position 22 cm below the nozzle face through a cooling space at an ambient temperature of 20° C. Endless nets made of stainless steel each having a width of 150 cm were disposed parallel at an interval of 45 mm in opening width to form a pair of take-up conveyors so as to be partially exposed over a water surface. The discharged filaments in a molten state were curled to form loops, and contact parts were fused to form a three-dimensional network structure. The network structure in a molten state was sandwiched at both surfaces by the take-up conveyors, and drawn into cooling water at a speed of 0.8 m per minute, thereby solidified, flattened at both surfaces, then cut into a predetermined size, and dried/heat-treated with hot air at 70° C. for 15 minutes to obtain a network structure. The properties of the obtained network structure formed of the ethylene-vinyl acetate copolymer are shown in Table 5.

The obtained network structure was formed of filaments with a solid cross-sectional shape such that the fiber diameter of the surface layer portion was 0.51 mm and the fiber diameter of the inner layer portion was 0.47 mm, and, in the network structure, an apparent density was 0.068 g/cm$^3$, a thickness of flattened surface was 46 mm, a 25%-compression hardness was 175 N/φ200 mm, a 40% hardness was 240 N/φ200 mm, a 65%-compression hardness was 550 N/φ200 mm, a 750 N repeated compression residual strain was 8.2%, a 40% hardness retention after 750 N repeated compression was 56.1%, a 65% hardness retention after 750 N repeated compression was 72.1%, and a compression-deflection coefficient was 3.1. The obtained network structure satisfied the requirements of the present invention, and had excellent repeated compression durability.

Example 3-2

A network structure was obtained by treatment being performed in the same manner as in Example 3-1 except that the ethylene-vinyl acetate copolymer C-2 was used. The properties of the obtained network structure formed of the ethylene-vinyl acetate copolymer C-2 are shown in Table 2.

The obtained network structure was formed of filaments with a solid cross-sectional shape such that the fiber diameter of the surface layer portion was 0.50 mm and the fiber diameter of the inner layer portion was 0.47 mm, and, in the network structure, an apparent density was 0.068 g/cm$^3$, a thickness of flattened surface was 46 mm, a 25%-compression hardness was 165 N/φ200 mm, a 40% hardness was 232 N/φ200 mm, a 65%-compression hardness was 530 N/φ200 mm, a 750 N repeated compression residual strain was 8.3%, a 40%-hardness retention after 750 N repeated compression was 61.1%, a 65%-hardness retention after 750 N repeated compression was 74.5%, and a compression-deflection coefficient was 3.2. The obtained network structure satisfied the requirements of the present invention, and had excellent repeated compression durability.

Example 3-3

The obtained ethylene-vinyl acetate copolymer C-1 was discharged to downward from a nozzle at a spinning temperature of 200° C. and a speed of 1.6 g/min. in terms of discharge amount per single hole through orifices each having an outer diameter of 2 mm, an inner diameter of 1.6 mm, a triple bridge hollow forming cross section, and staggered-arranged at a pitch between holes of 5 mm on a nozzle effective face of 1050 mm in the width direction and 60 mm in width in the thickness direction. Cooling water was arranged at a position 30 em below the nozzle face through a cooling space in a condition that an ambient temperature is 20° C., the temperature of cooling air is 40° C., and the speed of the cooling air was 0.2 m/sec. Endless nets made of stainless steel each having a width of 150 cm were disposed parallel at an interval of 45 mm in opening width to form a pair of take-up conveyors so as to be partially exposed over a water surface. The discharged filaments in a molten state were curled to form loops, and contact parts were fused to form a three-dimensional network structure. The network structure in a molten state was sandwiched at both surfaces by the take-up conveyors, and drawn into cooling water at a speed of 1.6 m per minute, thereby solidified, flattened at both surfaces, then cut into a predetermined size, and dried/heat-treated with hot air at 70° C. for 15 minutes to obtain a network structure. The properties of the obtained network structure formed of the ethylene-vinyl acetate copolymer C-1 are shown in Table 5.

The obtained network structure was formed of filaments such that the cross-sectional shape is a hollow cross-sectional shape, the degree of hollowness is 26%, the fiber diameter of the surface layer portion was 0.72 mm and the fiber diameter of the inner layer portion was 0.66 mm, and, in the network structure, an apparent density was 0.057 g/cm$^3$, a thickness of flattened surface was 46 mm, a 25%-compression hardness was 170 N/φ200 mm, a 40% hardness was 225 N/φ200 mm, a 65%-compression hardness was 523 N/φ200 mm, a 750 N repeated compression residual strain was 8.1%, a 40% hardness retention after 750 N repeated compression was 65.0%, a 65% hardness retention after 750 N repeated compression was 75.5%, and a compression-deflection coefficient was 3.1. The obtained network structure satisfied the requirements of the present invention, and had excellent repeated compression durability.

Example 3-4

A network structure was obtained by treatment being performed in the same manner as in Example 3-3 except that the ambient temperature in the cooling space was 15° C., and the interval, in the opening width of the endless net was 40 mm. The properties of the obtained network structure formed of the ethylene-vinyl acetate copolymer C-1 are shown in Table 5.

The obtained network structure was formed of filaments such that the cross-sectional shape is a hollow cross-sectional shape, the degree of hollowness is 26%, the fiber diameter of the surface layer portion was 0.75 mm and the fiber diameter of the inner layer portion was 0.67 mm, and, in the network structure, an apparent density was 0.064 g/cm$^3$, a thickness of flattened surface was 41 mm, a 25%-compression hardness was 215 N/φ200 mm, a 40% hardness was 278 N/φ200 mm, a 65%-compression hardness was 640 N/φ200 mm, a 750 N repeated compression residual strain was 8.1%, a 40%-hardness retention after 750 N repeated compression was 70.1%, a 65%-hardness retention after 750 N repeated compression was 80.2%, and a compression-deflection coefficient was 3.0. The obtained network structure satisfied the requirements of the present invention, and had excellent repeated compression durability.

Comparative Example 3-1

A network structure was obtained in the same manner as in Example 3-1 except that the spinning temperature was 180° C., no cooling space was provided, and the opening width of an endless net made of stainless steel was 50 mm. The properties of the obtained network structure formed of the ethylene-vinyl acetate copolymer C-1 are shown in Table 5.

The obtained network structure was formed of filaments with a solid cross-sectional shape such that the fiber diameter of the surface layer portion was 0.50 mm and the fiber diameter of the inner layer portion was 0.49 mm, and, in the network structure, an apparent density was 0.062 g/cm$^3$, a thickness of flattened surface was 50 mm, a 25%-compression hardness was 143 N/φ200 mm, a 40% hardness was 205 N/φ200 mm, a 65%-compression hardness was 430 N/φ200 mm, a 750 N repeated compression residual strain was 9.0%, a 40%-hardness retention after 750 N repeated compression was 47.1%, a 65%-hardness retention after 750 N repeated compression was 59.3%, and a compression-deflection coefficient was 3.0. The obtained network structure did not satisfy the requirements of the present invention, and had slightly poor repeated compression durability.

Comparative Example 3-2

A network structure was obtained in the same manner as in Example 3-3 except that the spinning temperature was 190° C., no cooling space was provided, no cooling air was blown, and the opening width of an endless net made of stainless steel was 50 mm. The properties of the obtained network structure formed of the ethylene-vinyl acetate copolymer C-1 are shown in Table 5.

The obtained network structure was formed of filaments such that the cross-sectional shape is a hollow cross-sectional shape, the degree of hollowness is 25%, the fiber diameter of the surface layer portion was 0.70 mm and the fiber diameter of the inner layer portion was 0.68 mm, and, in the network structure, an apparent density was 0.052 g/cm$^3$, a thickness of flattened surface was 50 mm, a 25%-compression hardness was 170 N/φ200 mm, a 40% hardness was 211 N/φ200 mm, a 65%-compression hardness was 410 N/φ200 mm, a 750 N repeated compression residual strain was 13.4%, a 40%-hardness retention after 750 N repeated compression was 42.0%, a 65%-hardness retention after 750 N repeated compression was 55.1%, and a compression-deflection coefficient was 2.4. The obtained network structure did not satisfy the requirements of the present invention, and had slightly poor repeated compression durability.

TABLE 5

| Item | Example 3-1 | Example 3-2 | Example 3-3 | Example 3-4 | Comparative Example 3-1 | Comparative Example 3-2 |
|---|---|---|---|---|---|---|
| Ethylene-vinyl acetate copolymer | C-1 | C-2 | C-1 | C-1 | C-1 | C-1 |
| Spinning temperature (° C.) | 190 | 190 | 200 | 200 | 180 | 190 |
| Discharge amount per single hole (g/min) | 1.0 | 1.0 | 1.6 | 1.6 | 1.0 | 1.6 |
| Ambient temperature (° C.) | 20 | 20 | 20 | 15 | — | — |
| Temperature of cooling air (° C.) | — | — | 40 | 40 | — | — |
| Speed of cooling air (m/min) | — | — | 0.2 | 0.2 | — | — |
| Take-up speed (m/min) | 0.8 | 0.8 | 1.6 | 1.6 | 0.8 | 1.6 |
| Nozzle face-cooling water distance (cm) | 22 | 22 | 30 | 30 | 22 | 30 |
| Apparent density (g/cm$^3$) | 0.068 | 0.068 | 0.057 | 0.064 | 0.062 | 0.052 |
| Thickness (mm) | 46 | 46 | 46 | 41 | 50 | 50 |
| Cross-sectional shape of the fiber | Solid | Solid | Hollow | Hollow | Solid | Hollow |
| Degree of hollowness | — | — | 26 | 26 | — | 25 |
| Fiber diameter of the surface layer portion (mm) | 0.51 | 0.50 | 0.72 | 0.75 | 0.50 | 0.70 |
| Fiber diameter of the inner layer portion (mm) | 0.47 | 0.47 | 0.66 | 0.67 | 0.49 | 0.68 |
| Surface layer fiber diameter/Inner layer fiber diameter (times) | 1.09 | 1.06 | 1.09 | 1.12 | 1.02 | 1.03 |
| 25%-compression hardness (N/φ200 mm) | 175 | 165 | 170 | 215 | 143 | 170 |
| 40%-compression hardness (N/φ200 mm) | 240 | 232 | 225 | 278 | 205 | 211 |
| 65%-compression hardness (N/φ200 mm) | 550 | 530 | 523 | 640 | 430 | 410 |
| 750N-constant load repeated compression residual strain (%) | 8.2 | 8.3 | 8.1 | 8.1 | 9.0 | 13.4 |
| 40%-hardness retention after 750N-constant load repeated compression (%) | 56.1 | 61.1 | 65.0 | 70.1 | 47.1 | 42.0 |

TABLE 5-continued

| Item | Example 3-1 | Example 3-2 | Example 3-3 | Example 3-4 | Comparative Example 3-1 | Comparative Example 3-2 |
|---|---|---|---|---|---|---|
| 65%-hardness retention after 750N-constant load repeated compression (%) | 72.1 | 74.5 | 75.5 | 80.2 | 59.3 | 55.1 |
| Compression-deflection coefficient | 3.1 | 3.2 | 3.1 | 3.0 | 3.0 | 2.4 |

INDUSTRIAL APPLICABILITY

The present invention provides a network structure in which durability after 750 N constant load repeated compression, which has been not satisfied by conventional products, is improved without deteriorating good sitting comfort and air permeability which have been given heretofore by network structures. There can be provided a network structure suitable for cushions that are used for office chairs, furniture, sofas, beddings such as beds, seats for vehicles such as those for trains, automobiles, two-wheeled vehicles, child seats, and buggies, and impact absorbing mats such as floor mats, and members for prevention of collision and nipping, etc, the network structure having a small reduction in thickness and a small reduction in hardness after a long period of use. For this reason, the network structure of the present invention significantly contributes to industries.

The invention claimed is:

1. A network structure comprising a three-dimensional random loop bonded structure obtained by forming random loops with curling treatment of a continuous linear structure including at least one thermoplastic elastomer selected from the group consisting of a polyester-based thermoplastic elastomer, a polyolefin-based thermoplastic elastomer, and an ethylene-vinyl acetate copolymer, and by making each loop mutually contact in a molten state, wherein a fiber diameter of the continuous linear structure is not less than 0.1 mm and not more than 3.0 mm, a fiber diameter of a surface layer portion of the network structure is not less than 1.05 times and not more than 1.14 times of a fiber diameter of an inner layer portion thereof, an apparent density is not less than 0.01 g/cm$^3$ and not more than 0.20 g/cm$^3$, 750 N-constant load repeated compression residual strain is not more than 15%, and 40%-compression hardness retention after 750 N-constant load repeated compression is not less than 55%.

2. The network structure according to claim 1, wherein 65%-compression hardness retention after 750 N-constant load repeated compression is not less than 70%.

3. The network structure according to claim 1, wherein a compression-deflection coefficient is not less than 2.5.

4. The network structure according to claim 1, wherein the network structure has a thickness of not less than 10 mm and not more than 300 mm.

5. The network structure according to claim 1, wherein 40%-compression hardness retention after 750 N-constant load repeated compression is not less than 60%.

6. The network structure according to claim 1, wherein 40%-compression hardness retention after 750 N-constant load repeated compression is not less than 65%.

7. The network structure according to claim 1, wherein 65%-compression hardness retention after 750 N-constant load repeated compression is not less than 73%.

* * * * *